US008602234B2

(12) United States Patent
Hayashi

(10) Patent No.: US 8,602,234 B2
(45) Date of Patent: Dec. 10, 2013

(54) CAP FOR CONTAINER HAVING PARTIALLY CUTTABLE CONNECTOR PORTION FOR REMOVAL OF CAP RETAINING RING

(76) Inventor: Syogo Hayashi, Sagamihara (JP)

( * ) Notice: Subject to any disclaimer, the term of this patent is extended or adjusted under 35 U.S.C. 154(b) by 0 days.

(21) Appl. No.: 13/476,763

(22) Filed: May 21, 2012

(65) Prior Publication Data

US 2012/0305564 A1 Dec. 6, 2012

(30) Foreign Application Priority Data

Jun. 3, 2011 (JP) ..... 2011-124836

(51) Int. Cl.
*B65D 55/16* (2006.01)

(52) U.S. Cl.
USPC ..... 215/252

(58) Field of Classification Search
USPC ..... 215/252, 253, 258, 329, 306; 220/288; 222/541.5, 541.6
See application file for complete search history.

(56) References Cited

U.S. PATENT DOCUMENTS

| | | | | | |
|---|---|---|---|---|---|
| 3,904,062 | A * | 9/1975 | Grussen | ..... | 215/252 |
| 4,557,393 | A * | 12/1985 | Boik | ..... | 215/253 |
| 4,805,792 | A * | 2/1989 | Lecinski, Jr. | ..... | 215/253 |

FOREIGN PATENT DOCUMENTS

| | | |
|---|---|---|
| JP | H03-75150 | 7/1991 |
| JP | 2001-019002 | 1/2001 |
| JP | 2005-330004 | 12/2005 |
| JP | 3167601 U | 5/2011 |
| WO | 2009/048273 | 4/2009 |

* cited by examiner

*Primary Examiner* — Steven A. Reynolds
*Assistant Examiner* — King M Chu
(74) *Attorney, Agent, or Firm* — Leighton K. Chong

(57) ABSTRACT

A cap for container which comprises a cap body provided with a thread portion at the inner peripheral surface of its upper portion which is engaged with a thread of an opening portion of a container, and a fixed portion connected with the cap body at a cuttable connector portion. The fixed portion comprises an upper ring, and a lower ring provided with lock projections to prevent the lower portion from the opening portion of the container. The upper ring and the lower ring are connected at a connector portion. The lower ring is provided with at least one cutting line extending from its bottom end to its upper end.

4 Claims, 6 Drawing Sheets

CAP FOR CONTAINER HAVING PARTIALLY CUTTABLE CONNECTOR PORTION FOR REMOVAL OF CAP RETAINING RING

TECHNICAL FIELD

This invention relates to a cap for container, and more particularly a cap for closing a container made of a plastic material such as PET (polyethylene terephthalate) resin.

BACKGROUND OF INVENTION

A plastic container is available in the market in the condition that it is filled with beverage such as water, juice or the like as a content and closed by a cap. Usually the cap is provided with a thread portion at the inner peripheral surface of its upper portion, and the thread portion is engaged with the thread portion which the container is provided with at the outer peripheral portion of its upper portion. The container is sealed by the cap by rotating the cap in a clockwise direction after the container is filled with beverage, and is opened by rotating the cap in a counter clockwise direction. The cap comprises two main portions, that is, a cap body and a fixed portion which is prevented from removing out from the groove of the container after the fixed portion is inserted in the groove. The cap body and the fixed portion are connected by a cuttable connecter portion such as perforations by which the cap body and the fixed portion can be separated. Therefore, when the sealing of the container is released, that is, the container is opened, only the cap body is removed out and the fixed portion remains on the opening portion of the container.

When the container is opened, since the cap body is separated from the fixed portion the cap body would be missed. The patent publication WO/2009/002057 discloses that the cap is provided with a connector portion for connecting the cap body and the fixed portion.

Since the container and the cap are different in their materials, the separated collection is required in some local governments. The fixed portion of the cap which is left on the opening portion of container should be removed out by using a special tool such as a nipper, which leads to time and labor consuming.

Therefore, it is an object of the present invention to provide a cap for container in which the fixed portion of cap can be easily removed out from the opening portion of container without using a special tool.

SUMMARY OF INVENTION

To accomplish the object, there is provided a cap for container which comprises a cap body provided with a thread portion at the inner peripheral surface of its upper portion which is engaged with a thread of an opening portion of a container, and a fixed portion connected with said cap body at a cuttable connector portion, said fixed portion comprising an upper ring, and a lower ring provided with lock projections to prevent said lower portion from the opening portion of said container, said upper ring and said lower ring being connected at a connector portion, and said lower ring being provided with at least one cutting line extending from its bottom end to its upper end.

Other objects, features, and advantages of the present invention will be explained in the following detailed description of the invention having reference to the appended drawings:

BRIEF DESCRIPTION OF DRAWINGS

FIG. 2A is its cross-sectional view, FIG. 2B is its bottom view, FIG. 2C is its enlarged view seen from the direction of arrow C in FIG. 2A, and FIG. 2D is its enlarged view seen from the direction of arrow D in FIG. 2A.

FIG. 4A is its cross-sectional view, FIG. 4B is its bottom view, FIG. 4C is its enlarged view seen from the direction of arrow C in FIG. 4A, and FIG. 4D is its enlarged view seen from the direction of arrow D in FIG. 4A.

DETAILED DESCRIPTION OF THE INVENTION

Figure 1:
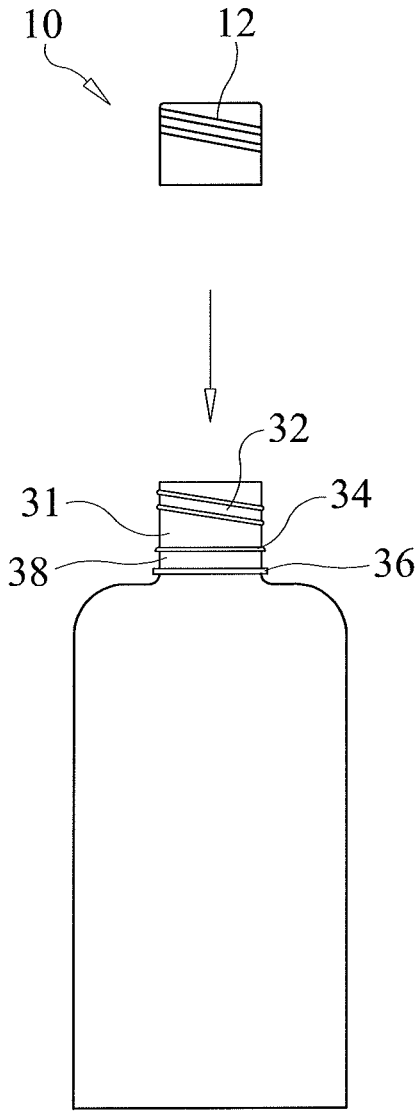
FIG. 1 is a diagrammatic front view showing a container and a cap.
Figure 3:
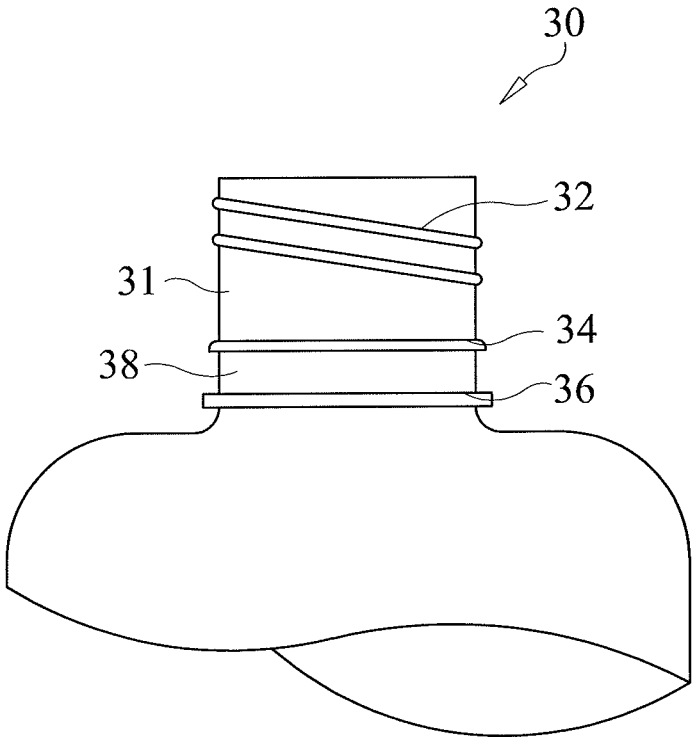
FIG. 3 is a front view showing opening portion of the container.
Figure 4A:
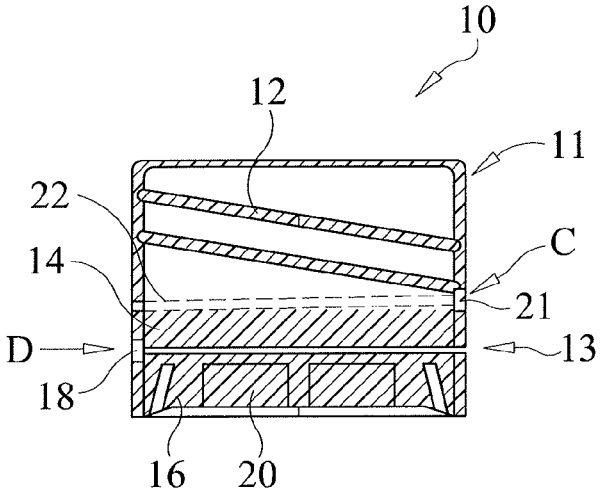
FIG. 4A-4D are is a views showing a second embodiment of a cap in accordance with the present invention, and particularly
Figure 4C:
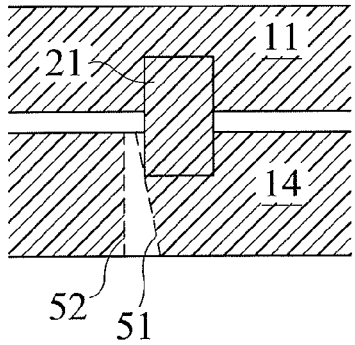
Figure 4B:
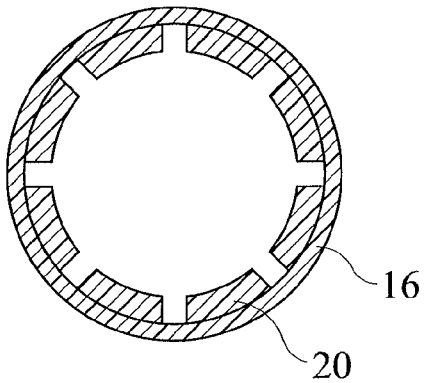
Figure 4D:
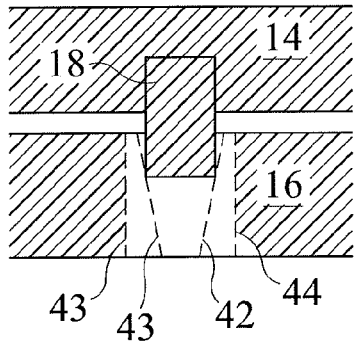

As shown in FIG. 1, a cap 10 in accordance with the present invention is provided with a thread portion 12 at the inner peripheral surface of upper portion of the cap while a container 30 is provided with a thread portion 32 at the outer peripheral portion of upper portion of its opening portion 31. The container is sealed by the cap by rotating the cap in a counter-clockwise direction so that the thread portion 12 is engaged with the thread portion 32 to screw the cap thereon. When the container is opened the cap is rotated in a clockwise direction. As shown in FIGS. 1 and 3, at the lower portion of opening portion 31 of the container 30, two ring portions 34 and 36 are provided, and a ring-shaped groove 38 is formed therebetween.

Referring now to FIG. 2, the cap comprises a cap body 11 and a fixed portion 13, and the cap body 11 and the fixed portion 13 is connected by a cuttable connector portion such as perforations. The fixed portion 13 comprises an upper ring 14 and a lower ring 16. The lower ring 16 is provided with lock projections 20 extending from its bottom toward upper central position at intervals on its periphery. When the container is capped to be closed, the lock projections are pushed radially and outwardly to be widely opened and thus the lower ring can be inserted into the groove 38. As shown in FIG. 2C, a plurality of separable or cuttable connector portions 24 is provided between the upper ring 14 and the lower ring 16. As far as the upper ring 14 and the lower ring 16 is separable, perforations may be formed therebetween instead of the connector portions.

Figure 2A:
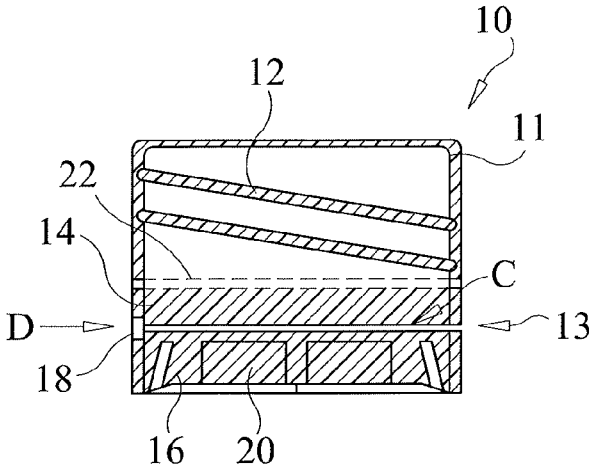
FIG. 2A-2D are is a views showing a first embodiment of a cap in accordance with the present invention, and particularly
Figure 2C:
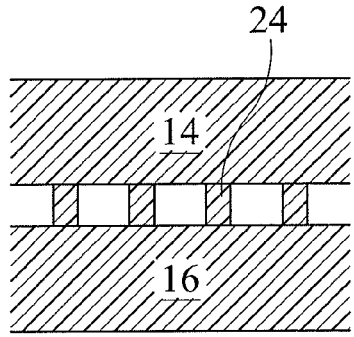
Figure 2B:
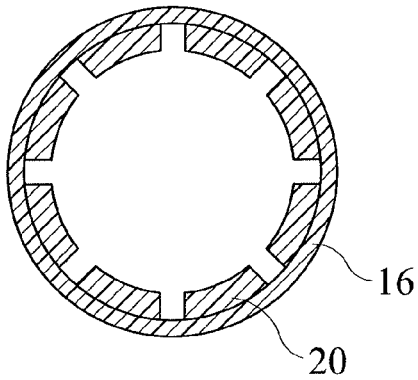
Figure 2D:
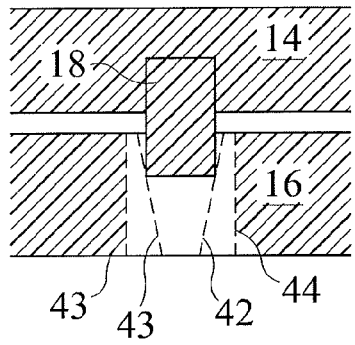

As shown in the enlarged view of FIG. 2D, the upper ring 14 and the lower ring 16 are connected to each other by a connecting portion such as a flexible hinge portion 18. The connecting portion may be made in the form of a strip instead of the hinge. The lower ring 16 is provided with a separable or cuttable portion such as perforations or cut which is cut out when the upper ring 14 is pulled upwardly. It is preferable that the cuttable portion is made of a single perpendicular line 43 or 44, or two lines 43 and 44, a single oblique line 41 or 42, or two lines 41 and 42. It is also preferable that the cuttable portion is formed adjacent the hinge portion 18.

Figure 5:
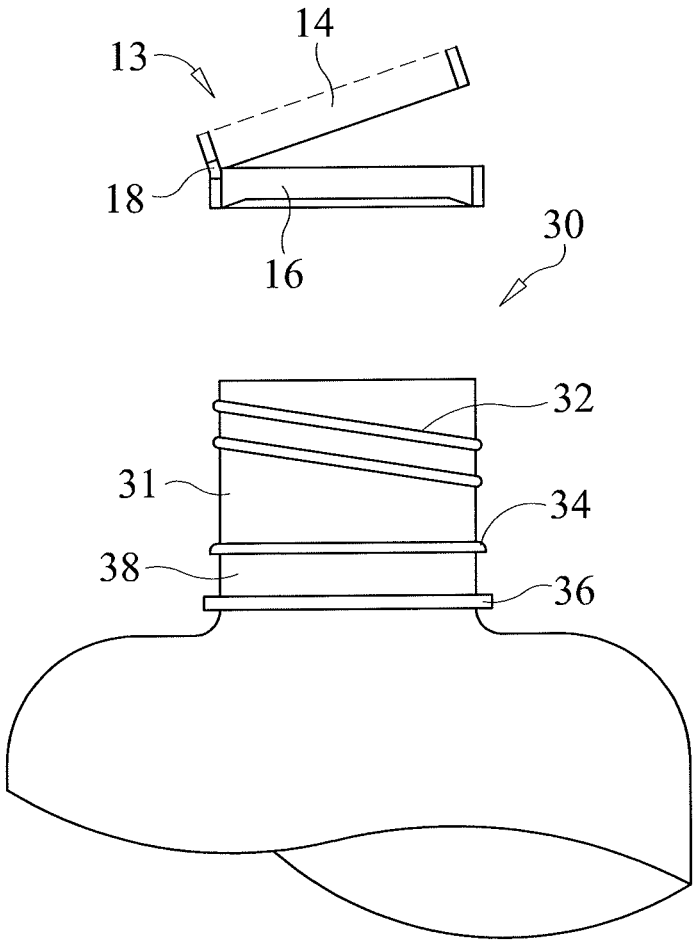
FIG. 5 is a view for explanation when the cap is removed from the container.

Now referring to FIG. 5, the closing and opening operation of the opening portion by the first embodiment of cap will be explained. For illustration of drawing, The cap 10 and the container 30 are shown individually. Firstly, the container 30 is capped by putting the cap 10 on the opening portion 31 of the container 30 and then rotating the cap in a clockwise direction. At that time, the cap body 11 reaches the position on the ring portion 34 while the fixed portion 13 is positioned in the groove 38. When the cap 10 is rotated in a counter clockwise direction to open the container, the cap body 11 is guided by the thread to be moved upwardly. At that time, the lower ring 16 is made to be engaged with the ring portion 34 due to existence of its lock projections 20 and then is not moved upwardly further more. As a result, only the cap body 11 is raised, the perforations 22 provided between the cap body 11 and the upper ring 14 of fixed portion 13 is cut out and then the cap body 11 is separated from the fixed portion 13. At the same time the cuttable connector portion 24 provided between the upper ring 14 and lower ring 16 of fixed portion 14 are separated, and thus the upper ring 14 and the lower ring 16 are separated in a condition that they are connected only by the hinge portion 18. The FIG. 5 shows this state.

In the above-mentioned state, only upper ring 14 of fixed portion 13 projects above the upper ring portion 34. When the container is capped by the cap body the upper ring 14 is inserted into the groove 38 again. Furthermore, the upper ring 14 can be raised by fingers.

The separated collection is made as follows. When the upper ring is grasped by fingers and pulled upwardly, one or more cuttable lines 41 or 42, or 43 or 44 of the lower ring 16 is cut out. When one line is cut out, the lower ring is developed to become a strip, and the lower ring 16 is easily removed out from the groove 38. When the two lines are cut out, the lower ring also becomes a strip, and then the lower ring 16 is easily removed out from the groove 38.

Figure 6:
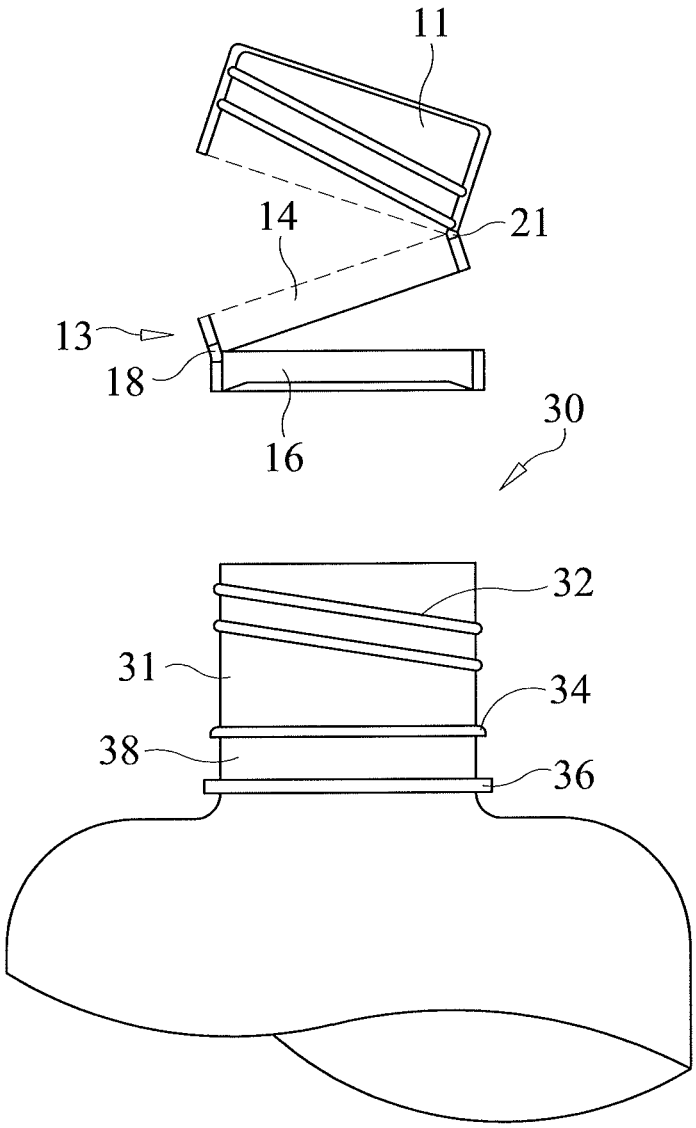
FIG. 6 is a view for explanation when the sealing condition of the container is released.

Now referring to FIGS. 4 and 6, the second embodiment of cap will be explained. For illustration of drawing, the cap 10 and the container 30 are shown individually. The second embodiment is mainly different from the first embodiment in that a hinge portion or strip 21 is provided between the cap body 11 and the upper ring 14 of the fixed portion 13. Since the other construction in accordance with the second embodiment is the same as that of the first embodiment the detailed explanation will be omitted.

As shown in FIG. 4, the hinge portion 21 is provided at the approximately opposite side of the hinge portion 18. The cuttable line 51 or 52 may be provided adjacent the hinge portion 21. When the container is opened as shown in FIG. 6, the upper ring 14 of fixed portion 13 is moved out from the groove 38. At the time, since the cap body 11 and the upper ring 14 is connected by the hinge portion 21, they are not separated completely. As a result, the cap body 11 is prevented from missing.

In the separated collection, when the cap body 11 or the upper ring 14 is pulled upwardly, the lower ring becomes a strip. In a case that the cuttable line 51 or 52 is provided that portion is also cut out and then the upper ring becomes a strip. As a result the lower ring 16 can be easily removed out.

It is understood that many modifications and variations may be devised given the above description of the principles of the invention. It is intended that all such modifications and variations be considered as within the spirit and scope of this invention, as it is defined in the following claims.

The invention claimed is:

1. A cap for container which comprises:

a cap body provided with a thread portion at an inner peripheral surface of an upper portion of said cap body which is engageable with a thread of an opening portion of a container, and a lower portion having an upper ring that is attached to the upper portion of the cap body and a lower ring that is connected to the upper ring by a partially cuttable connector portion, wherein the lower ring is configured to initially remain attached to a lower portion of the opening portion of the container when the partially cuttable connector portion is severed to allow the cap body to be removed from the opening portion of the container while being hinged by a remaining connector portion connecting the upper ring to the lower ring, said upper ring being provided with at least one cutting line extending from a bottom end to an upper end thereof to enable said upper ring to be removed from the opening portion of the container when the at least one cutting line is separated, and said lower ring being provided with at least one cutting line extending from its bottom end to its upper end to enable said lower ring to be removed from the opening portion of the container when its at least one cutting line is separated.

2. A cap for container according to claim 1 in which said remaining connector portion connecting the upper ring to the lower ring is made in the form of a hinge.

3. A cap for container according to claim 1 in which an additional cuttable line and remaining connector portion is provided between the upper portion of said cap body and said upper ring in order to allow the upper portion of said cap body to remain attached to the upper ring when the additional cuttable line is severed.

4. A cap for container according to claim 3 in which said remaining connector portion provided between the upper portion of said cap body and said upper ring is made in the form of a hinge.

* * * * *